US007752700B2

(12) United States Patent
Rouillard et al.

(10) Patent No.: US 7,752,700 B2
(45) **Date of Patent: *Jul. 13, 2010**

(54) CLEANING BULLET

(75) Inventors: Carol A. Rouillard, Loveland, OH (US); James M. Scolaro, Racine, WI (US); Ronald Rhea Dir, Sturtevant, WI (US)

(73) Assignee: Diversey, Inc., Sturtevant, WI (US)

( * ) Notice: Subject to any disclaimer, the term of this patent is extended or adjusted under 35 U.S.C. 154(b) by 500 days.

This patent is subject to a terminal disclaimer.

(21) Appl. No.: 11/226,474

(22) Filed: Sep. 14, 2005

(65) Prior Publication Data

US 2007/0056606 A1 Mar. 15, 2007

(51) Int. Cl.
*B08B 9/04* (2006.01)

(52) U.S. Cl. ..... 15/104.061; 15/211; 15/212

(58) Field of Classification Search ..... 15/3.5, 15/104.05, 104.061, 111, 112
See application file for complete search history.

(56) References Cited

U.S. PATENT DOCUMENTS

| | | | | |
|---|---|---|---|---|
| 2,408,240 | A | 9/1946 | Stone | 15/88 |
| 3,543,323 | A | 12/1970 | Girard | |
| 3,875,606 | A | 4/1975 | Landers | 15/104 |
| 4,083,074 | A * | 4/1978 | Curtis | 15/104.061 |
| 4,208,755 | A * | 6/1980 | Shepherd | 15/160 |
| 4,244,073 | A | 1/1981 | Sagawa | 15/104 |
| 4,365,379 | A * | 12/1982 | Neff | 15/104.061 |
| 5,140,718 | A * | 8/1992 | Toth | 15/210.1 |
| 5,161,919 | A | 11/1992 | Smith et al. | |
| 5,208,936 | A | 5/1993 | Campbell | |
| 5,244,505 | A | 9/1993 | Allison et al. | |
| 5,457,841 | A | 10/1995 | Minton | |
| 5,484,237 | A | 1/1996 | Langenbeck | |
| 5,625,917 | A | 5/1997 | Hawkins | |
| 5,695,302 | A | 12/1997 | Hilbish | 406/88 |
| 6,176,938 | B1 * | 1/2001 | Palmer | 134/8 |
| 6,332,740 | B1 | 12/2001 | Bernard et al. | |
| 6,368,027 | B1 | 4/2002 | Trenel et al. | |
| 6,514,015 | B1 | 2/2003 | Trenel et al. | |

(Continued)

FOREIGN PATENT DOCUMENTS

DE 25 44 878 A1 4/1977

(Continued)

OTHER PUBLICATIONS

PCT/US2006/035595 International Search Report dated Feb. 27, 2007 (4 pages).

(Continued)

*Primary Examiner*—Michael Barr
*Assistant Examiner*—Saeed T Chaudhry
(74) *Attorney, Agent, or Firm*—Gregory S. Bollis

(57) ABSTRACT

A cleaning bullet for use in a pipe or track includes a compressible body. In one embodiment, a sheet draped over the body is engageable with interior walls of the pipe or track to clean small contaminants. In another embodiment, the body is formed from an absorbent material that absorbs a fluid, such as a cleaning solution, that can clean and/or disinfect the interior walls of the pipe or track. In yet another embodiment, an alignment key extends radially from a body axis for guiding the cleaning bullet in an air conveyor track.

33 Claims, 3 Drawing Sheets

U.S. PATENT DOCUMENTS

| | | | | |
|---|---|---|---|---|
| 6,527,869 | B1 | 3/2003 | Bourg | 134/1 |
| 6,890,128 | B2 | 5/2005 | Seidl et al. | |
| 2004/0074030 | A1 | 4/2004 | Nehrbass | 15/104 |
| 2007/0056606 | A1 | 3/2007 | Rouillard et al. | |

FOREIGN PATENT DOCUMENTS

| | | | |
|---|---|---|---|
| EP | 1 102 018 A | | 5/2001 |
| EP | 1102018 | * | 5/2001 |
| JP | 60082527 | | 5/1985 |
| JP | 2002-192095 | | 7/2002 |

OTHER PUBLICATIONS

PCT/US2008/063049 International Search Report dated Jul. 28, 2008 (3 pages).

* cited by examiner

CLEANING BULLET

CROSS REFERENCES TO RELATED APPLICATIONS

Not Applicable.

STATEMENT REGARDING FEDERALLY SPONSORED RESEARCH

Not Applicable.

TECHNICAL FIELD

This invention relates to pipe and elongated track cleaning, and in particular to a cleaning bullet propelled through the pipe or track to clean the interior of the pipe or track.

DESCRIPTION OF THE BACKGROUND ART

Air conveyor systems are often used in the beverage industry to transport bottles by the bottle neck. These conveyor systems typically includes elongated tracks defining a longitudinal slot through which the neck of the bottle extends. Compressed air directed at various portions of the bottle urges the bottle along a conveyor path. The interior of the track often accumulate dust, microorganisms, and other contaminants during operation which can enter the bottles and contaminate the product contained therein and impede bottle movement. As a result, the track must be cleaned on a regular basis to ensure the proper operation and sanitation of the track. Track cleaning is currently done manually by laboriously wiping the track with a dampened cloth. Since the air conveyor system track is typically overhead, this cleaning requires the use of lift devices that increase the time and cost of the cleaning.

Pipeline pigs are often used to clean the interior surfaces of long stretches of pipe. The pig is propelled through the pipe by a compressed fluid to dislodge contaminants adhering to pipe interior walls. The pigs typically include a body having an outer circumference that conforms with the interior of the pipe being cleaned. Unfortunately, these pigs must be in an enclosed pipe in order to operate effectively and small contaminants are often left undisturbed. Accordingly, the use of known pipeline pigs in an air conveyor track will not sufficiently clean an air conveyor track. Therefore, a need exists for a cleaning device that can operate efficiently in slotted tracks and pipes to clean small contaminants, such as dust and microorganisms.

SUMMARY OF THE INVENTION

The present invention provides a cleaning bullet having a compressible body. In one embodiment, a sheet draped over the body is engageable with interior walls of the pipe or track to clean small contaminants. In another embodiment, the body is formed from an absorbent material that absorbs a fluid, such as a cleaning solution, that can clean and/or disinfect the interior walls of the pipe or track. In yet another embodiment, an alignment key extends radially from a body axis for guiding the cleaning bullet in an air conveyor track.

A general objective of the present invention is to provide a cleaning bullet that can operate effectively in slotted tracks and pipes to clean small contaminants, such as dust and microorganisms. This objective is accomplished in one embodiment by draping a disposable sheet, such as formed from a micro fiber material, over the body for wiping the interior walls of the pipe or track. In another embodiment, this objective is accomplished by forming the body from an absorbent material and soaking the body in a fluid, such as a cleaning solution, which is then applied to the interior walls of the pipe or track.

Another objective of the present invention is to provide a cleaning bullet that can be used in an air conveyor track. This objective is accomplished in one embodiment by providing an alignment key extending radially from the body axis, wherein the alignment key is engageable with the track to guide the cleaning bullet along the track.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

Figure 1:
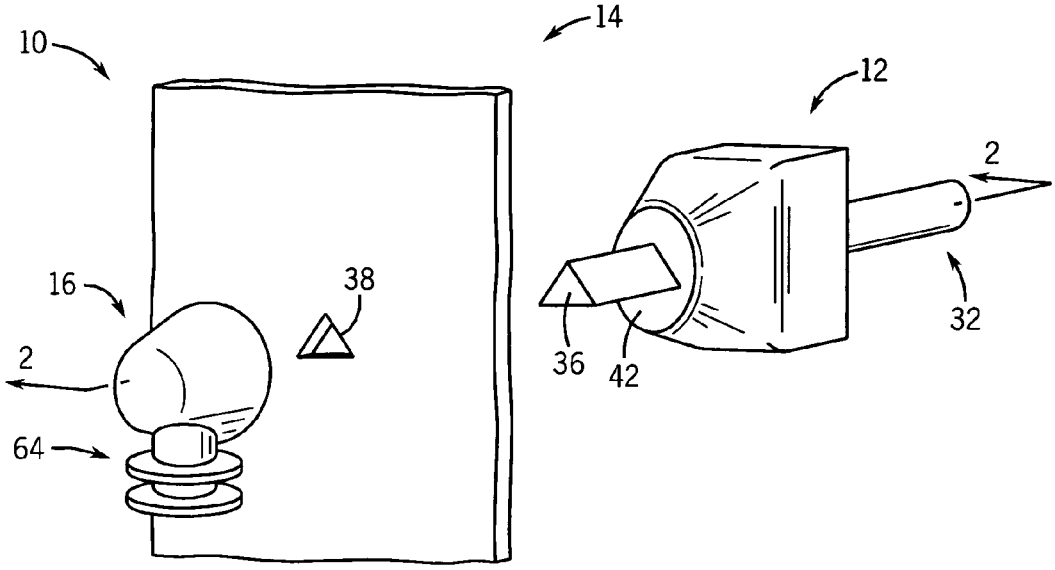
FIG. 1 is a perspective exploded view of a cleaning bullet incorporating the present invention.
Figure 2:
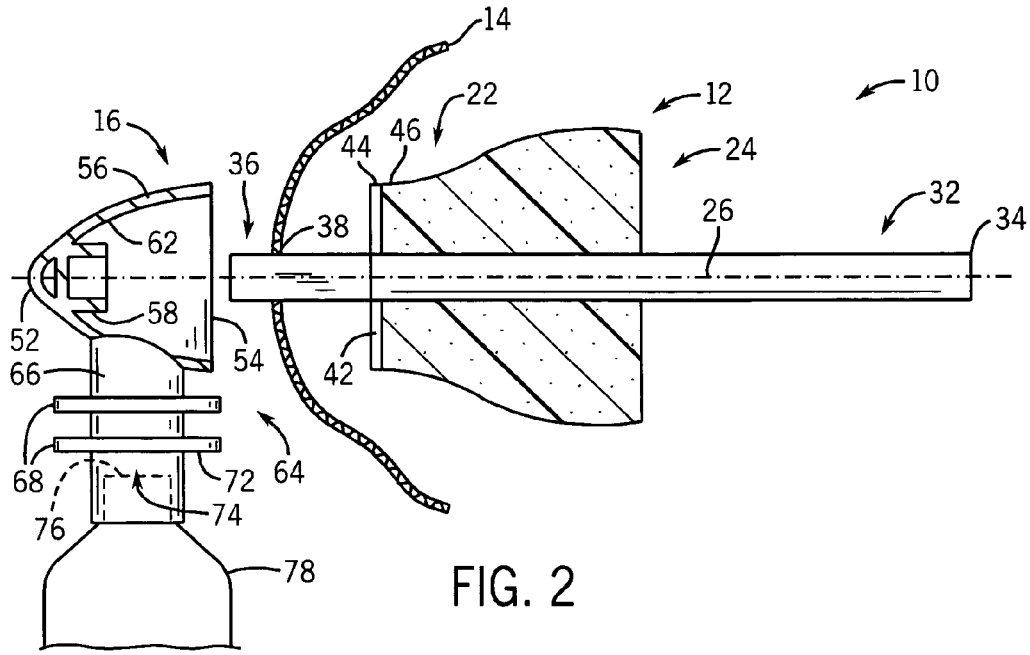
FIG. 2 is a sectional view along line 2-2 of FIG. 1.

A cleaning bullet 10, shown in FIGS. 1 and 2, incorporating the present invention is suitable for use in pipes and slotted tracks. The bullet 10 includes a body 12 propelled through the pipe or track. A disposable sheet 14 fixed to the body 12 engages the pipe or track interior walls to dislodge contaminant, particles, and the like, from the walls and clean the pipe or track interior. A nose 16 fixed relative to the body 12 secures the sheet 14 relative to the body 12.

The body 12 is formed from a compressible material that biases the sheet 14 against the pipe or track interior walls. In a preferred embodiment, the body 12 is formed, such as by molding, thermoforming, and the like, from an absorbent sponge-like material, such as foamed polyurethane, that can be saturated with a fluid, such as water or a solution containing a cleaning fluid, that will clean, or even disinfect, the pipe or track interior walls on contact. Advantageously, the compressible body 12 allows the same bullet to be used in pipe or track having different cross sections and diameters.

In the embodiment disclosed herein, the body 12 includes a frustoconical leading end 22 that forms into a square trailing end 24 along a body axis 26 for use in a track having a square cross section. Of course, the shape of the trailing end 24 can be formed to conform to the particular shape of the pipe or track being cleaned. For example, a bullet 10 having a circular trailing end is more suitable for use in a pipe having a circular cross section.

A handle 32 extending rearwardly from the body trailing end 24 substantially coaxial with the body axis 26 simplifies inserting the bullet 10 into the pipe or track. The handle 32 is preferably, an elongated rigid rod 34 formed from any suitable material, such as wood, plastic, metal, and the like, around which the body 12 is formed. In the embodiment disclosed herein, the rod extends forwardly past the leading end 22 of the body 12 to form a peg 36 for fixing the disposable sheet 14 relative to the body 12 and mounting the nose 16 thereon.

The disposable sheet 14 is draped over the leading end 22 of the body 12 and extends rearwardly over the body 12 to clean the interior walls of the pipe or track. Advantageously, the compressible body 12 urges the sheet 14 against the interior walls to effectively clean the interior walls. Preferably, the sheet 14 is formed from a micro fiber material that is known to efficiently clean surfaces and form fitted to the body 12 to minimize bunching and the resulting excess friction die to the bunched sheet 14. However, the sheet 14 can be formed from any material suitable for the particular application, such as paper, plastic, natural material, synthetic material, woven material, non-woven material, fabric, and the like. An aperture 38 die cut through the sheet 14 receives the peg 36 to locate and fix the sheet 14 relative to the body 12. Advantageously, the sheet 14 can be used dry or soaked in a fluid, such as water, a cleaning solution, and the like, that can clean and/or disinfect the interior walls of the pipe or track. The sheet 14 can be soaked prior to fixing it to the cleaning bullet body 12 or if the body 12 is formed from an absorbent material, receive fluid absorbed in the body 12.

A circular front plate 42 fixed to the leading end 22 of the body 12 couples with the nose 16 to secure the disposable sheet 14 relative to the body 12. The front plate 42 is formed from any suitable material, such as plastic, and has a peripheral edge 44 aligned with a peripheral edge 46 of the leading end 22 of the body 12. The circular front plate 42 can be formed as an integral part of the rod 34, as a separate part, or eliminated without departing from the scope of the invention.

The nose 16 is detachably mounted to the peg 36 and couples with the front plate 42 to secure the sheet 14 relative to the body 12. The nose 16 includes a closed rounded leading end 52 joined to an open trailing end 54 by a nose wall 56. The open trailing end 54 couples with the front plate 42 to pinch the sheet 14 between the nose 16 and the front plate peripheral edge 44. A receptacle 58 extending rearwardly from an inner surface 62 of the nose leading end 52 receives the peg 36 to mount the nose 16 relative to the body 12, and retains the nose 16 on the peg 36 using a friction fit. Of course, other methods for fixing the nose 16 relative to the body 12 can be used, such as threads, mechanical fasteners, a snap fit, and the like, without departing from the scope of the invention.

The embodiment disclosed in FIGS. 1 and 2 includes an alignment key 64 especially suited for guiding the cleaning bullet 10 in a air conveyor track having a longitudinal slot for conveying objects, such as beverage bottles. The alignment key 64 is preferably formed as an integral part of the nose 16, and includes a shaft 66 extending radially relative to the body axis 26 and downwardly from the nose wall 56 into the longitudinal slot of the track. Spaced discs 68 formed proximal a distal end 72 of the shaft 66 engage the track in a manner similar to the objects conveyed by the air conveyor.

The alignment key 64 centers the bullet 10 in the track to maintain the disposable sheet 14 in contact with the track interior walls. Of course, the shape of the alignment key 64 can be modified for use in other tracks without departing from the scope of the invention. Although forming the alignment key 64 as an integral part of the nose 16 is preferred, the alignment key 64 can be formed independent of the nose 16, and can extend from the body 12, peg 36, or handle 32 without departing from the scope of the invention. Moreover, although an alignment key 64 is disclosed, the alignment key 64 can be deleted when the cleaning bullet 10 is used in an enclosed pipe without departing from the scope of the invention.

In a preferred embodiment, the alignment key 64 includes a threaded, cylindrical, downwardly opening cavity 74 for threadably receiving a bottle top 76 of a bottle 78. The bottle 78 hangs down from the alignment key 64 and acts as a counterweight which inhibits the cleaning bullet 10 from twisting in the track. Advantageously, compressed air directed at the bottle 78 propels the cleaning bullet 10 through the track.

In use, the disposable sheet 14 is draped over the body 12 with the peg 36 extending through the sheet aperture 38. The sheet 14 is then secured relative to the body 12 by mounting the nose 16 on the peg 36 and pinching the sheet 14 between the nose 16 and front plate 42. If desired, the body 12 and/or sheet 14 can be saturated with a liquid solution that enhances cleaning and/or disinfects the interior walls of the pipe or track.

The cleaning bullet 10 is inserted into an open end of the pipe or track by grasping the handle 32 of the bullet 10 and slipping the bullet 10 into the open end of the pipe or track. If the nose 16 includes the alignment key 64, the key 64 is engaged with the slot to guide the bullet 10 in the track. The bullet 10 is then propelled through the pipe or track using methods known in the art, such as compressed air, and the like. Bottles, or other objects, normally conveyed through the pipe or track, can be inserted into the open end after insertion of the cleaning bullet 10 to push the cleaning bullet 10 ahead of the bottles, or other objects.

Figure 3:
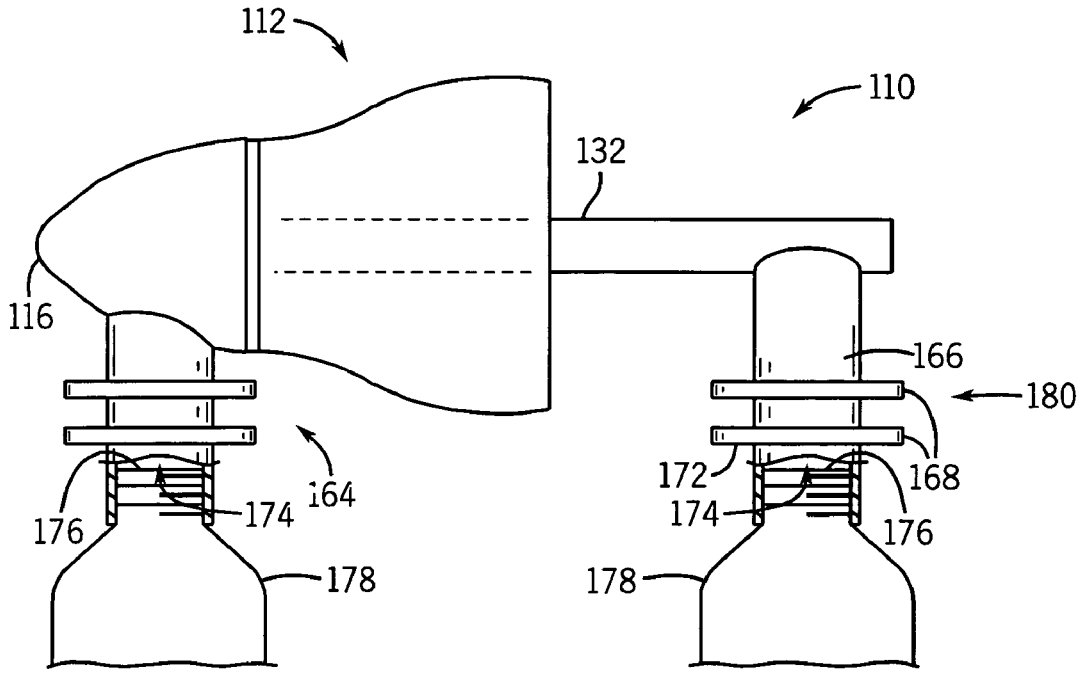
FIG. 3 is side view of an alternate embodiment of the present invention including two alignment keys.

In an alternative embodiment shown in FIG. 3, a cleaning bullet 110 has a nose 116 including a leading edge alignment key 164, a body 112, and a trailing edge alignment key 180. The body 112 is substantially identical to the body 12 shown in FIGS. 1 and 2, and is interposed between the leading edge and trailing edge alignment keys 164, 180. The leading edge alignment key 164 is substantially identical to the alignment key 64 shown in FIGS. 1 and 2, and depends downwardly from the nose 116.

The trailing edge alignment key 180 is fixed relative to the leading edge alignment key 164, such as by mounting the trailing edge alignment key 180 on a handle 132 extending rearwardly from the nose 116 through the body 112. The trailing edge alignment key 180 includes a radially extending shaft 166 extending downwardly into the longitudinal slot of the track. Spaced discs 168 formed proximal a distal end 172 of the shaft 166 engage the track in a manner similar to the objects conveyed by the air conveyor.

Preferably, both the leading edge alignment key 164 and trailing edge alignment key 180 include a threaded, cylindrical, downwardly opening cavity 174. Each cavity 174 threadably receives a bottle top 176 of a bottle 178. The bottles 178 hang down from the alignment keys 164, 180 adjacent opposing ends of the body 112 and act as counterweights which lower the center of gravity of the assembly. Advantageously, the bottles 178 inhibit the cleaning bullet 110 from twisting and tipping forward in the track.

Figure 4:
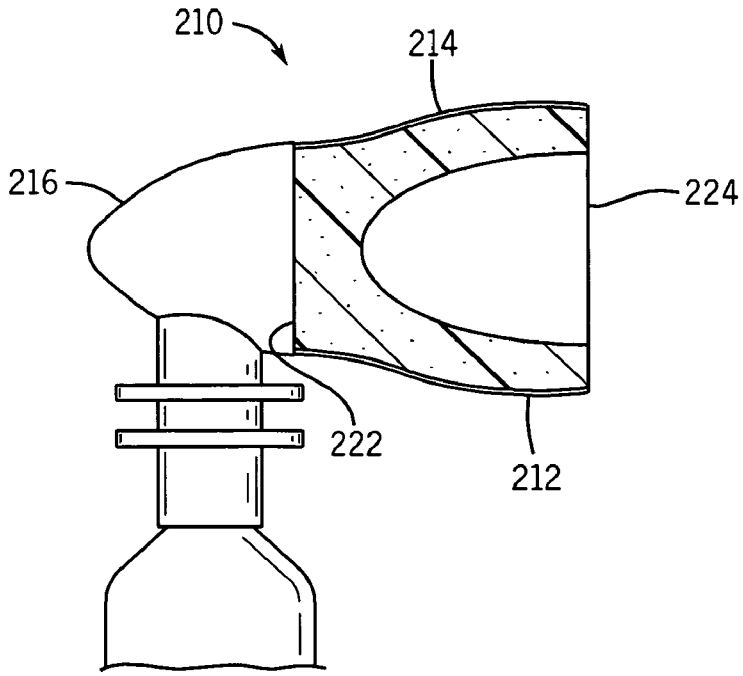
FIG. 4 is side view of an alternate embodiment of the invention including an expandable body.

In another embodiment shown in FIG. 4, a cleaning bullet 210 includes a body 212 formed from a hollow flexible material that expands to conform to the interior shape of the track. A leading end 222 of the body 212 is closed and fixed to a cleaning bullet nose 216. A trailing end 224 of the body 212 is open. Compressed air propelling the cleaning bullet 210 along the track is received in the open trailing end 224 and expands the body 212 to urge a sheet 214 against the track walls. The flexible material can be any suitable material, such as an expandable plastic, pleated non-expandable plastic, metal, or paper, and the like. Advantageously, the expandable body 212 efficiently captures the compressed air for propulsion through the track and more readily adapts to different track sizes.

Figure 5:
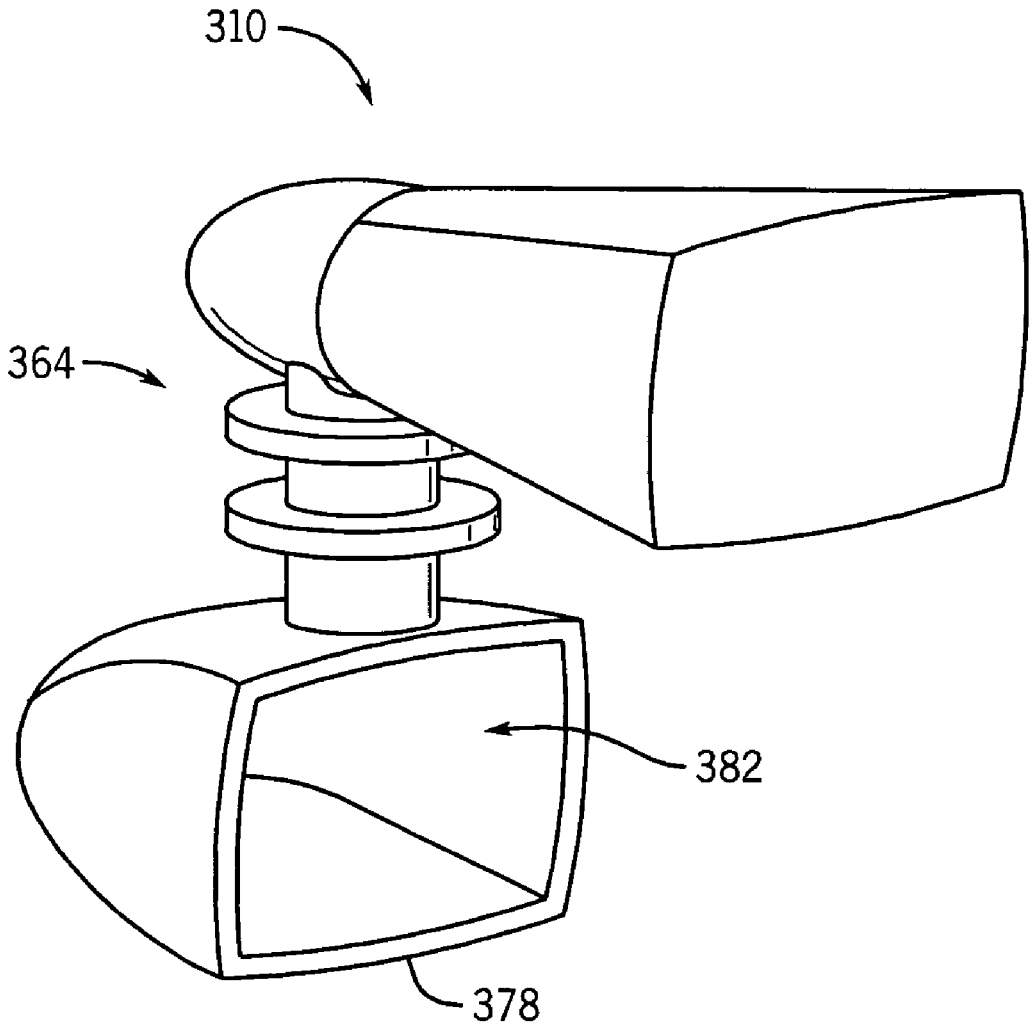
FIG. 5 is perspective view of an alternate embodiment of the invention including an air trap.

In yet another embodiment of the present invention shown in FIG. 5, a cleaning bullet 310 includes an air trap 378 extending downwardly from an alignment key 364 captures compressed air to propel the cleaning bullet 310 along the track. The air trap 378 includes a rearwardly opening cavity 382 formed from molded plastic. Preferably, the air trap 378 is formed as an integral part of the alignment key 364. However, the air trap 378 can be detachably mounted to the alignment key 364, such as the bottles described above, without departing from the scope of the invention. Advantageously, the air trap 378 propels the cleaning bullet 310 more efficiently than directing compressed air on the cleaning bullet 310 alone or with a bottle attached thereto.

While there has been shown and described what is at present considered the preferred embodiment of the invention, it will be obvious to those skilled in the art that various changes and modifications can be made therein without departing from the scope of the invention defined by the appended claims. For example, the embodiment disclosed herein includes a body draped with a disposable sheet. Alternative embodiments can include a nondisposable sheet that is reused or the entire device including the body can be disposable without departing from the scope of the invention.

We claim:

1. A cleaning bullet for use in a track having a cross-sectional area with a periphery, said bullet comprising:

a compressible body having a leading end and a trailing end, said body defining an axis extending between said leading end and said trailing end; and a sheet draped over said leading end and fixed relative to said body, said compressible body urging said sheet against an interior wall of the track, wherein a portion of the cleaning bullet is positioned to extend outside a periphery of the track when said body is inside the track and is located fully within the track.

2. The cleaning bullet as in claim 1, including a nose detachably fixed relative to said body forwardly of said leading end, said sheet being interposed between said nose and said body.

3. The cleaning bullet as in claim 1, including a first alignment key extending radially relative to said axis for engagement with a slot formed in the track.

4. The cleaning bullet as in claim 3 including a second alignment key extending radially relative to said axis for engagement with a slot formed in the track, wherein said body is interposed between said first and second alignment keys.

5. The cleaning bullet as in claim 1, in which said body is formed from an absorbent material.

6. The cleaning bullet as in claim 5, including a fluid absorbed by said body for wiping onto said interior wall of the track.

7. The cleaning bullet as in claim 1, including a counterweight fixed relative to said body.

8. The cleaning bullet as in claim 7, in which said counterweight is a bottle detachable fixed to said cleaning bullet.

9. The cleaning bullet as in claim 1, including an air trap which captures compressed air to propel said cleaning bullet.

10. A cleaning bullet for use in a track, said bullet comprising:

a compressible body having a leading end and a trailing end, said body defining an axis extending between said leading end and said trailing end;

a nose detachably fixed relative to said body forwardly of said leading end, wherein a portion of the cleaning bullet is positioned to extend outside a periphery of the track when said body is inside the track and is located fully within the track.

11. The cleaning bullet as in claim 10, in which a sheet draped over said leading end and fixed relative to said body is interposed between said nose and said body.

12. The cleaning bullet as in claim 10, including a first alignment key extending radially relative to said axis for engagement with a slot formed in the track.

13. The cleaning bullet as in claim 12, including a second alignment key extending radially relative to said axis for engagement with a slot formed in the track, wherein said body is interposed between said first and second alignment keys.

14. The cleaning bullet as in claim 10, in which said body is formed from an absorbent material.

15. The cleaning bullet as in claim 10, including a fluid absorbed by said body for wiping onto an interior wall of the track.

16. The cleaning bullet as in claim 10, including a counterweight fixed relative to said nose.

17. The cleaning bullet as on claim 16, in which said counterweight is a bottle detachable fixed to said cleaning bullet.

18. The cleaning bullet as in claim 10, including an air trap which captures compressed air to propel said cleaning bullet.

19. A cleaning bullet for use in an inverted track, said bullet comprising:

a compressible absorbent body having a leading end and a trailing end, said body defining an axis extending between said leading end and said trailing end and being supported by and suspended from the inverted track; a sheet draped over said leading end and fixed relative to said body, said compressible body urging said sheet against an interior wall of the track; and a fluid absorbed by said body for wiping onto an interior wall of the track, wherein a portion of the cleaning bullet is positioned to extend outside a periphery of the track when said body is inside the track and is located fully within the track.

20. The cleaning bullet as in claim 19, including a nose detachably fixed relative to said body forwardly of said leading end.

21. The cleaning bullet as in claim 19, including an alignment key extending radially relative to said axis for engagement with the track.

22. The cleaning bullet as in claim 21, including a second alignment key extending radially relative to said axis for engagement with a slot formed in the track, wherein said body is interposed between said first and second alignment keys.

23. The cleaning bullet as in claim 19, including a counterweight fixed relative to said nose.

24. The cleaning bullet as on claim 23, in which said counterweight is a bottle detachable fixed to said cleaning bullet.

25. The cleaning bullet as in claim 19, including an air trap which captures compressed air to propel said cleaning bullet.

26. A cleaning bullet for use in a track having a cross-sectional area with a periphery, said bullet comprising:

a compressible body having a leading end and a trailing end, said body defining an axis extending between said leading end and said trailing end; and a sheet draped over said leading end and fixed relative to said body, said compressible body urging said sheet against an interior wall of the track, wherein a portion of the cleaning bullet is positioned to extend outside a periphery of the track when said body is inside the track in movement of the cleaning bullet along the track.

27. The cleaning bullet as in claim 26, including a nose detachably fixed relative to said body forwardly of said leading end, said sheet being interposed between said nose and said body.

28. The cleaning bullet as in claim 26, including a first alignment key extending radially relative to said axis for engagement with a slot formed in the track.

29. The cleaning bullet as in claim 28 including a second alignment key extending radially relative to said axis for engagement with a slot formed in the track, wherein said body is interposed between said first and second alignment keys.

30. The cleaning bullet as in claim 26, in which said body is formed from an absorbent material.

31. The cleaning bullet as in claim 30, including a fluid absorbed by said body for wiping onto said interior wall of the track.

32. The cleaning bullet as in claim 26, including a counterweight fixed relative to said body, in which said counterweight is a bottle detachable fixed to said cleaning bullet.

33. The cleaning bullet as in claim 26, including an air trap which captures compressed air to propel said cleaning bullet.

* * * * *